US009502146B2

(12) United States Patent
Bertholdt et al.

(10) Patent No.: US 9,502,146 B2
(45) Date of Patent: Nov. 22, 2016

(54) PROCESS FOR DISSOLVING AN OXIDE LAYER

(71) Applicants: Horst-Otto Bertholdt, Nuremberg (DE); Alexander Landner, Schaafheim (DE); Andreas Loeb, Niddatal (DE); Hartmut Runge, Alzenau (DE); Dieter Stanke, Schollkrippen (DE)

(72) Inventors: Horst-Otto Bertholdt, Nuremberg (DE); Alexander Landner, Schaafheim (DE); Andreas Loeb, Niddatal (DE); Hartmut Runge, Alzenau (DE); Dieter Stanke, Schollkrippen (DE)

(73) Assignees: Horst-Otto Bertholdt, Nurnberg (DE); NIS INGENIEURGESELLSCHAFT MBH, Alzenau (DE)

( * ) Notice: Subject to any disclaimer, the term of this patent is extended or adjusted under 35 U.S.C. 154(b) by 155 days.

(21) Appl. No.: 14/200,327

(22) Filed: Mar. 7, 2014

(65) Prior Publication Data

US 2014/0338696 A1 Nov. 20, 2014

(30) Foreign Application Priority Data

Mar. 8, 2013 (DE) ..... 10 2013 102 331

(51) Int. Cl.

| | |
|---|---|
| ***G21F 9/00*** | (2006.01) |
| ***G21F 9/12*** | (2006.01) |
| ***G21F 9/30*** | (2006.01) |
| ***C23G 1/02*** | (2006.01) |

(52) U.S. Cl.

CPC ..... *G21F 9/004* (2013.01); *C23G 1/02* (2013.01); *G21F 9/12* (2013.01); *G21F 9/30* (2013.01)

(58) Field of Classification Search

CPC ..... G21F 9/004; G21F 9/12; G21F 9/34; C23G 1/00; C23G 1/02; B08B 2240/00

USPC ..... 134/2, 3, 42

See application file for complete search history.

(56) References Cited

U.S. PATENT DOCUMENTS

| | | | | |
|---|---|---|---|---|
| 4,481,040 | A | 11/1984 | Brookes et al. | |
| 4,678,552 | A | 7/1987 | Chen | |
| 4,756,768 | A | 7/1988 | Bertholdt et al. | |
| 2011/0303238 | A1* | 12/2011 | Gassen | G21F 9/001 134/3 |
| 2012/0298586 | A1* | 11/2012 | Grandbois | C22B 3/42 210/670 |

FOREIGN PATENT DOCUMENTS

| | | | |
|---|---|---|---|
| DE | 69012677 | T2 | 3/1995 |
| DE | 102009002681 | A1 | 9/2010 |
| EP | 242449 | B1 | 12/1990 |
| EP | 0355628 | B1 | 11/1993 |
| EP | 0753196 | B1 | 9/1998 |
| EP | 1082728 | B1 | 8/2002 |
| WO | 9415001 | A2 | 7/1994 |
| WO | 2006029823 | A2 | 3/2006 |
| WO | 2007062743 | A2 | 6/2007 |

* cited by examiner

*Primary Examiner* — Saeed T Chaudhry
(74) *Attorney, Agent, or Firm* — Ladas & Parry LLP

(57) ABSTRACT

The invention relates to a process for dissolving a chromium, iron, nickel, zinc and radionuclides containing oxide layer, in particular for breaking down oxide layers deposited on inner surfaces of systems and components of a nuclear power plant, by means of an aqueous decontamination solution containing methanesulfonic acid, which flows in a loop, wherein in regular intervals small amounts of permanganic acid are added, and following reaction of the permanganic acid a second loop is added on in bypass and the dissolved cations and anions are removed by ion-exchange resins from the decontamination solution.

16 Claims, 3 Drawing Sheets

Figure 1:
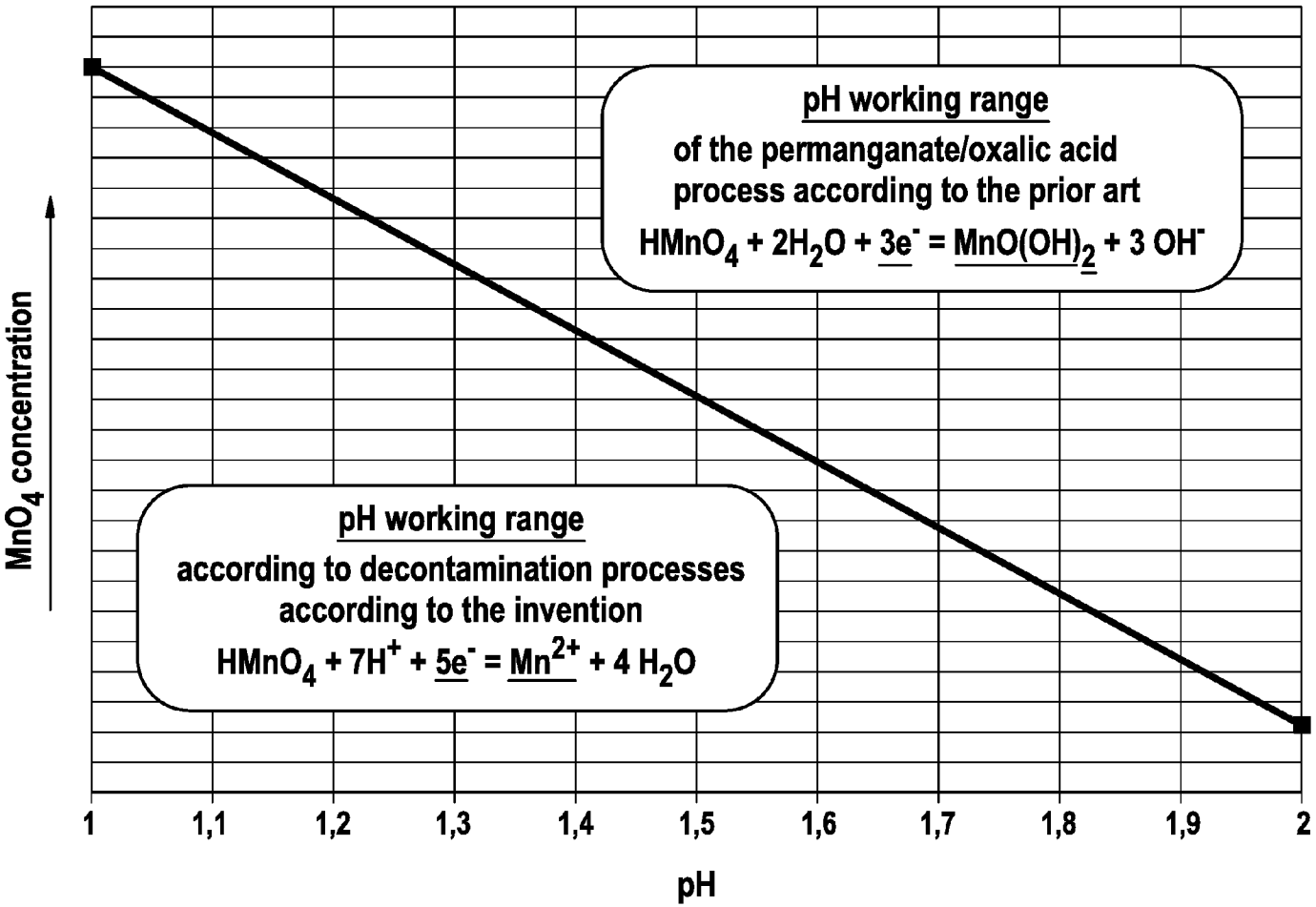

K1 = decont.loop of the primary system

DE = steam generator
RDB = reactor pressure vessel
HKMP = main coolant pump

K2 = bypass loop for removal of dissolved cations, anions, and radio nuclides

IT = ion exchanger resin container

PROCESS FOR DISSOLVING AN OXIDE LAYER

This application claims priority to German Application No. 102013102331.2, filed Mar. 8, 2013.

The invention relates to a process for dissolving a chromium, iron, nickel, zinc and radionuclides containing oxide layer, in particular breaking down oxide layers deposited on inner surfaces of systems and components of a nuclear power plant, by means of an aqueous decontamination solution containing an acid.

More particularly, the invention relates to a process for comprehensive breakdown of the radionuclides in the primary system and the auxiliary systems in a nuclear power plant using the existing operating medium and the power plant's operating systems.

During power operation of a nuclear power plant, protective oxide layers are formed at an operating temperature of >180° C. on the internal surfaces of the medium-wetted systems and components. Hereby, radionuclides are incorporated into the oxide matrix. The objective of chemical decontamination processes is to dissolve this oxide layer in order to be able to remove any bound radionuclides. The purpose hereby is to ensure that in the event of an outage period, the radiation exposure of revision personnel is as low as possible, or in the case of demolition of the nuclear reactor the metallic materials of the components can be easily recycled.

Due to their composition and structure ($Fe_{0.5}Ni_{1.0}Cr_{1.5}O_4$, $NiFe_2O_4$), the protective oxide layers are considered chemically undissolvable. By an initial oxidative chemical treatment of the oxide structure, the latter can be broken down and the sparingly soluble oxide matrix can be transformed into highly soluble metal oxides. This breaking of the oxide matrix is done by oxidation of trivalent chromium with formation of hexavalent chromium:

$$Fe_{0.5}Ni_{1.0}Cr_{1.5}O_4/NiFe_2O_4/Fe_3O_4 \rightarrow \text{oxidation} \rightarrow CrO_4^{2-}, FeO, NiO, Fe_2O_3 \qquad \text{Equation (1)}$$

Globally, the so-called "permanganate peroxidation" according to equation (2) has been established, with the following three oxidation treatments being available:

"NP" oxidation=nitric acid+potassium permanganate (nitric acid, permanganate) (see, for example, EP 0 675 973 B1)

"AP" oxidation=sodium hydroxide+potassium permanganate (alkaline, permanganate)

"HP" oxidation=permanganic acid (see, for example, EP 0 071 336 A1, EP 0 160 831 B1)

$$\text{Mn-VII+Cr-III} \rightarrow \text{Mn-IV+Cr-VI}$$

$$2MnO_4^{1-} + Cr_2O_3 \rightarrow 2MnO_2 + Cr_2O_7 \qquad \text{Equation (2)}$$

The manganese ion in permanganate is present in oxidation state 7 and, in accordance with equation (2), is reduced to oxidation state 4, while, at the same time, chromium, present in the trivalent oxidation state, is oxidized to oxidation state 6. According to equation (2), under acidic conditions 2 mol of $MnO_4^-$ are needed for the oxidation of 1 mol of $Cr_2O_3$.

A chemical decontamination of an entire primary system including all activity-carrying auxiliary systems has been carried out only in a few nuclear power plants. In recent years, about 50 different decontamination processes have been developed worldwide. Of all these processes, only those technologies based on a leading pre-oxidation with permanganates ($MnO_4^-$) prevailed.

Currently, available chemical decontamination processes are in principle carried out in the following order of processing steps (=decontamination cycle):

Step I: pre-oxidation step
Step II: reduction step
Step III: decontamination step
Step IV: decomposition step
Step V: final cleaning step.

In this case, the sequence of steps I to V is carried out three to six times (three to six decontamination cycles) one after the other.

All processes use permanganate (potassium permanganate, permanganic acid) for pre-oxidation (I) and oxalic acid for reduction (II). Processes differ only in the decontamination step (III). Here, different chemicals and mixtures of chemicals are used.

The previous decontamination processes are based on the concept discussed above. Sparingly soluble protective oxide layers are converted to more easily soluble oxide compounds in the course of a pre-oxidation step and remain on the surface of the system. During pre-oxidation, therefore, activity is not removed from the systems to be decontaminated. So far, a reduction of the dose rate does not take place in this period of decontamination.

Only after the second process step (II) of reduction of permanganates and any manganese dioxide formed by means of oxalic acid and in decontamination step (III) the oxides are dissolved and the dissolved cations/radionuclides are discharged and bound to ion exchange resins.

In all decontamination technologies previously utilized, manganese oxide hydrate [$MnO(OH)_2$] and manganese dioxide ($MnO_2$), respectively, form during pre-oxidation (I), as equation (2) illustrates.

Manganese oxide hydrate/manganese dioxide is insoluble and is deposited on the inner surface of the components/systems. Increasing manganese oxide hydrate/manganese dioxide deposition interferes with the desired oxidation of the protective oxide layer. In addition, converted iron and nickel oxides remain undissolved on the surface, so that the barrier layer on the surface increases further.

At the end of the pre-oxidation step the following new chemical compounds are present in the system to be decontaminated, either introduced or formed in step (I):

on the system surface: $MnO_2$, NiO, FeO, $Fe_2O_3$, $Fe_3O_4$ in the pre-oxidation solution: $KMnO_4$, NaOH or $HNO_3$, colloidal $MnO(OH)_2$, $CrO_4^{2-}$ or $Cr_2O_7^{2-}$.

Accordingly, at the end of the pre-oxidation step all metal oxides including radionuclides are still present in the system to be decontaminated. To some extent, manganese oxide hydrate/manganese dioxide that formed was entered in areas of the system that are not flushed and no longer can be discharged/removed in further process steps.

According to the prior art, radioactivity is not reduced in the course of oxidation of the oxide layer, i.e., no decontamination, since essentially no cations are dissolved from the oxide layer which could be removed using a cation exchanger. Rather, the dissolution of the oxide layer is carried out by means of oxalic acid in a second process step, with an upstream reduction step to reduce excess permanganic acid and manganese oxide hydrate. Only after these steps, cations are removed from the cleaning solution (decontamination solution) by ion exchange.

The object of the present invention is to avoid the disadvantages of the prior art, in particular to enable a simplified procedure, wherein the formation of manganese dioxide and metal oxalates is avoided. The formation of $CO_2$ is excluded. Also, the release of oxide particles is largely avoided.

To solve the problem it is provided in essence that the dissolution of the oxide layer is taking place in a single treatment step using an aqueous decontamination solution flowing in a first loop (K1) with methanesulfonic acid as the acid, that during the entire carrying out of the decontamination methanesulfonic acid remains in the decontamination solution both as a proton donor to adjust the decontamination solution at a pH≤2.5 and as oxide solvent, that the dissolution of chrome-containing oxide layers is done with permanganic acid and that following break-down of the permanganic acid the solution flows, while maintaining the operation of the first loop (K1) via a bypass line in a second loop (K2) through an ion exchanger (IT), in which the present 2- and 3-valent cations and the dissolved radionuclides are fixed, with simultaneous release of methanesulfonic acid.

According to the invention, the objective is essentially achieved in

- that oxidation of the oxide layer and its dissolution takes place in a single treatment step using an aqueous decontamination solution,
- that methanesulfonic acid is used as decontamination acid,
- that said methanesulfonic acid is used both to adjust the pH and for dissolving the metal oxides, and
- that the soluble methanesulfonates, after breaking down the permanganic acid, flow via a bypass line through an ion exchanger, in which the dissolved cations and radionuclides are fixed, with simultaneous release of methanesulfonic acid.

According to the invention, it is provided that at the beginning of the procedure the pH is specified by the metered addition of methanesulfonic acid. During the oxidative breakdown of the layer and the process steps carried out in this context, there is no need for any further addition of methanesulfonic acid.

According to the invention, a process is provided to reduce the activity inventory in components and systems, wherein the oxide layers of medium-wetted inner surfaces are removed by means of a decontamination solution. In this context, the decontamination can be carried out with the power plant's own systems without the aid of external decontamination support systems, the activity breakdown can take place without manganese dioxide formation and other cation precipitations and without producing $CO_2$ and without any release of oxide particles, and, at the same time, the metal oxides are chemically dissolved and fixed as cations/anions together with the manganese and said nuclides (Co-60, Co-58, Mn-54, etc.) on ion exchange resins.

The process can be carried out using the loop or a part of the loop that is present in a nuclear facility such as a nuclear power plant. Insofar, the facilities own, such as the power plant's own systems are used.

In contrast to previous decontamination concepts described above, according to the invention, the chemical conversion of sparingly soluble oxides in highly soluble oxides, the dissolution of the oxides/radionuclides and the discharge and fixing of the dissolved cations to ion exchangers are carried out in a single process step.

Furthermore, and in contrast to the prior art, according to the invention, the permanganic acid used is converted completely to the $Mn^{2+}$ cation. A manganese oxide hydrate/manganese dioxide precipitation does not occur.

By the reaction of manganese VII to manganese II 5 equivalents (electrons) are available for the oxidation of $Cr_2O_3$. This means that in comparison with the previous decontamination procedures, according to the teaching of the invention the amount of $Cr_2O_3$ that can be oxidized to chromate/dichromate is almost double.

In previous permanganate-based decontamination concepts, per 100 g of permanganate ions used:

43 g of Cr-III are oxidized to Cr-VI 72.5 g of $MnO(OH)_2$ precipitate.

In the decontamination concept according to the present invention, per 100 g of permanganate ions used:

73 g of Cr-III are oxidized to Cr-VI there are no $MnO(OH)_2/MnO_2$ precipitations.

According to the teaching of the present invention, both the pH as well as the permanganic acid and the proton donor (methanesulfonic acid) are matched according to a fixed logistic scheme such that in the course of carrying out the decontamination:

- no manganese dioxide can form
- any single oxides (FeO, $Fe_2O_3$, $Fe_3O_4$, NiO) formed by the decay of the sparingly soluble spinel/magnetite oxides are simultaneously chemically dissolved
- the forming manganese, iron and nickel methanesulfonates are highly soluble
- the dissolved cations ($Fe^{3+}$, $Fe^{2+}$, $Ni^{2+}$ and $Mn^{2+}$) and the radionuclides are fixed on ion exchanger.

The formation of manganese dioxide described above following the NP-, AP- or HP-oxidation is avoided according to the invention by using permanganic acid in the acidic range (pH<2.5, preferably pH≤2.2, in particular pH≤2). The $Mn^{2+}$ forming in acidic medium, according to the invention, is removed from the solution already during the "decontamination step" by means of ion exchanger according to equation (3):

$$a)\ 6HMnO_4+5Cr_2O_3+2H^+6Mn^{2+}\rightarrow+5Cr_2O_7+4H_2O \qquad \text{Equation (4)}$$

$$b)\ Mn^{2+}+H_2KIT\rightarrow[Mn^{2+}KIT]+2H^+ \qquad \text{Equation (4)}$$

FIG. 1 shows the interaction between pH (=acid concentration) and permanganate content. If the pH is exceeded in the curve shown, manganese dioxide is formed in the oxidation reaction [equations (2) and (3)]. Below the curve, the reaction proceeds with formation of the $Mn^{2+}$ cation [equation (4)].

According to the present invention, the required pH of <2.5, in particular ≤2.2, preferably pH≤2.0 is set by adding methanesulfonic acid. From the acids available, methanesulfonic acid meets the necessary requirements for the decontamination process according to the invention, such as

- methanesulfonic acid is stable towards permanganate
- it is neither oxidatively degraded nor chemically altered
- permanganic acid is not reduced by methane sulfonic acid, there is no formation of manganese dioxide ($MnO_2$)
- metal oxides are dissolved and form highly soluble methanesulfonates
- an extra addition of mineral acids (sulfuric acid, nitric acid), organic carboxylic acids (oxalic acid, ascorbic acid, etc.) and complexing agents is not required
- the dissolved cations are bound to cation exchange resins, methanesulfonic acid is available again for use in the process
- the base material is not impacted.

Due to the properties listed above, at the end of the "oxidative decontamination step" methanesulfonic acid is still available for the next steps.

Any oxides (NiO, $Ni_2O_3$, FeO) arising in the course of the "oxidative decontamination step" are dissolved by the methanesulfonic acid already during the "$HMnO_4$ stage".

According to the present invention, methanesulfonic acid is used for pH adjustment. The amount of methane sulfonic acid that is necessary to avoid the formation of $MnO(OH)_2$ depends on the permanganate concentration. With increasing permanganate concentration, the pH must be lowered, i.e., a higher acid concentration must be set (FIG. 1).

As a guideline, the following pH values apply:

at 0.1 mol permanganic acid per liter, a pH of about 1 at 0.01 mol permanganate per liter, a pH of about 2

When carrying out the "$HMnO_4$ stage", the concentration of free protons ($H^+$) is reduced by the formation of metal methanesulfonates. The amount of dissolved Fe, Ni, Zn, Mn cations is therefore included in the calculation of the additional methanesulfonic acid requirements according to the following formulas:

$$\text{mg } CH_3SO_3^{-1}\text{/liter}=[\text{mg cation per liter}]\times[\text{cation specific-factor}].$$

According to the present invention, depending on the Fe/Cr/Ni/Zn composition of the protective layer, the amount of individual cations which is released in each respective "$HMnO_4$ stage" can be calculated precisely in advance as a function of the $HMnO_4$ used. This is possible because 100% of the amount of $HMnO_4$ used is converted to $Mn^{2+}$ thereby forming a stoichiometric amount of dichromate. The amount of oxidized Cr-III, in turn, predetermines the amount of the converted Fe/Cr/Ni/Zn oxides and thus the Fe/Ni/Zn/Mn ions forming at the "$HMnO_4$ stage".

During the oxide conversion at the "$HMnO_4$ stage" and the simultaneous dissolution of the new oxide structures the system to be contaminated is operated in loop K1 without ion exchanger integration, i.e. without cycle K2. This is illustrated in principle in FIG. 3. During the entire decontamination operation, loop K1 is in operation. Loop K2 is added on to loop K1 in bypass, when the conversion of the amount of $HMnO_4$ to $Mn^{2+}$ is 100% complete.

To minimize the necessary use of methanesulfonic acid, the "$HMnO_4$ stage" is carried out preferably at a $HMnO_4$ concentration of ≤50 ppm of $HMnO_4$. During the "$HMnO_4$ stage", the following chemical partial reactions take place (equations (4) to (7)):

Oxidizing and dissolving $Cr_2O_3$ incorporated in the protective layer ($Fe_{0.5}Ni_{1.0}Cr_{1.5}O_4$):

$$6HMnO_4 5Cr_2O_3+12CH_3SO_3H\rightarrow 6[Mn(CH_3SO_3)_2]+5H_2Cr_2O_7+4H_2O \quad \text{Equation (4)}$$

By oxidation of Cr-III oxide under formation of water-soluble dichromate, Ni-II oxide (NiO), Fe-III oxide ($Fe_2O_3$) and Zn-II oxide (ZnO) are released from the oxide matrix and dissolved by methanesulfonic acid (equation (5) to (7)).

$$NiO+2CH_3SO_3H\rightarrow Ni(CH_3SO_3)_2+H_2O \quad \text{Equation (5)}$$

$$Fe_2O_3+6CH_3SO_3H\rightarrow 2[Fe(CH_3SO_3)_3]+3H_2O \quad \text{Equation (6)}$$

$$ZnO+2CH_3SO_3H\rightarrow Zn(CH_3SO_3)_2+H_2O \quad \text{Equation (7)}$$

The above-depicted chemical reactions (equations (4) to (7)) take place simultaneously.

To speed up the "$HMnO_4$ reaction" and the "methane sulfonic acid reaction" the process temperature is set preferably between 60° C. and 120° C.

According to the present invention, the decontamination preferably takes place in a temperature range of 85° C. to 105° C.

Figure 3:
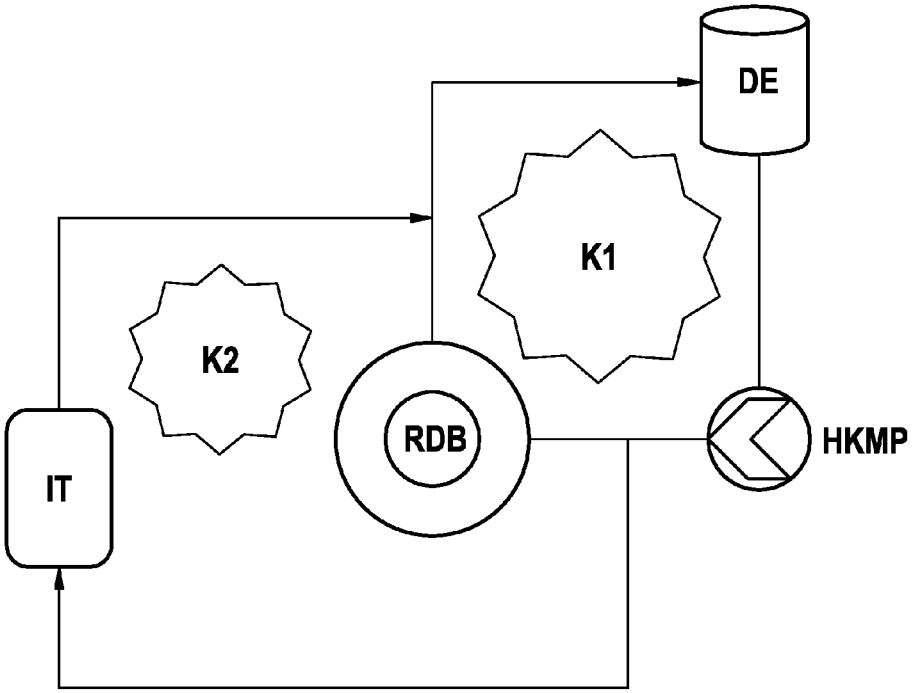

This is illustrated by the diagram in FIG. 3. During the conversion of permanganate to $Mn^{2+}$ the solution is circulated in the system to be decontaminated (loop K1). Following the conversion of permanganate, the solution is passed through ion exchanger IT in the bypass via a cleaning loop K2.

Requirement for the inclusion of an ion exchanger is that the permanganate has completely or substantially converted to $Mn^{2+}$ and the solution is free of $MnO_4^-$ ions (reference value <2 ppm of $MnO_4$).

During the operation of the ion exchanger IT, the di- and trivalent cations (Mn-II, Fe-II, Fe-III, Zn-II and Ni-II) and radionuclides (Co-58, Co-60, Mn-54, etc.) are removed from the solution. At the same time, methanesulfonic acid is released and is again available for use in the process. See equations (8) to (11).

Release of Methane Sulfonic $$Mn(CH_3SO_4)_2+H_2KIT\rightarrow 2CH_3SO_4H+[Mn^{2+}\text{-KIT}] \quad \text{Equations (8)}$$

$$Ni(CH_3SO_4)_2+H_2KIT\rightarrow 2CH_3SO_4H+[Ni^{2+}\text{-KIT}] \quad \text{Equations (9)}$$

$$Fe(CH_3SO_4)_2+H_2KIT\rightarrow 2CH_3SO_4H+[Fe^{2+}\text{-KIT}] \quad \text{Equations (10)}$$

$$2Fe(CH_3SO_4)_3+3H_2KIT\rightarrow 6CH_3SO_4H+[Fe^{3+}\text{-KIT}] \quad \text{Equations (11)}$$

The ion exchanger IT is operated at a process temperature of ≤100° C.

The operation of the ion exchanger IT continues in bypass until all dissolved cations, anions and radionuclides are fixed on the ion exchange resin.

According to the present invention, following ion exchanger cleaning, bypass loop K2 will be closed and more permanganic acid will be added into loop K1. The process steps described above are repeated until no further discharge of activity from the system K1 to be decontaminated occurs.

Figure 2:
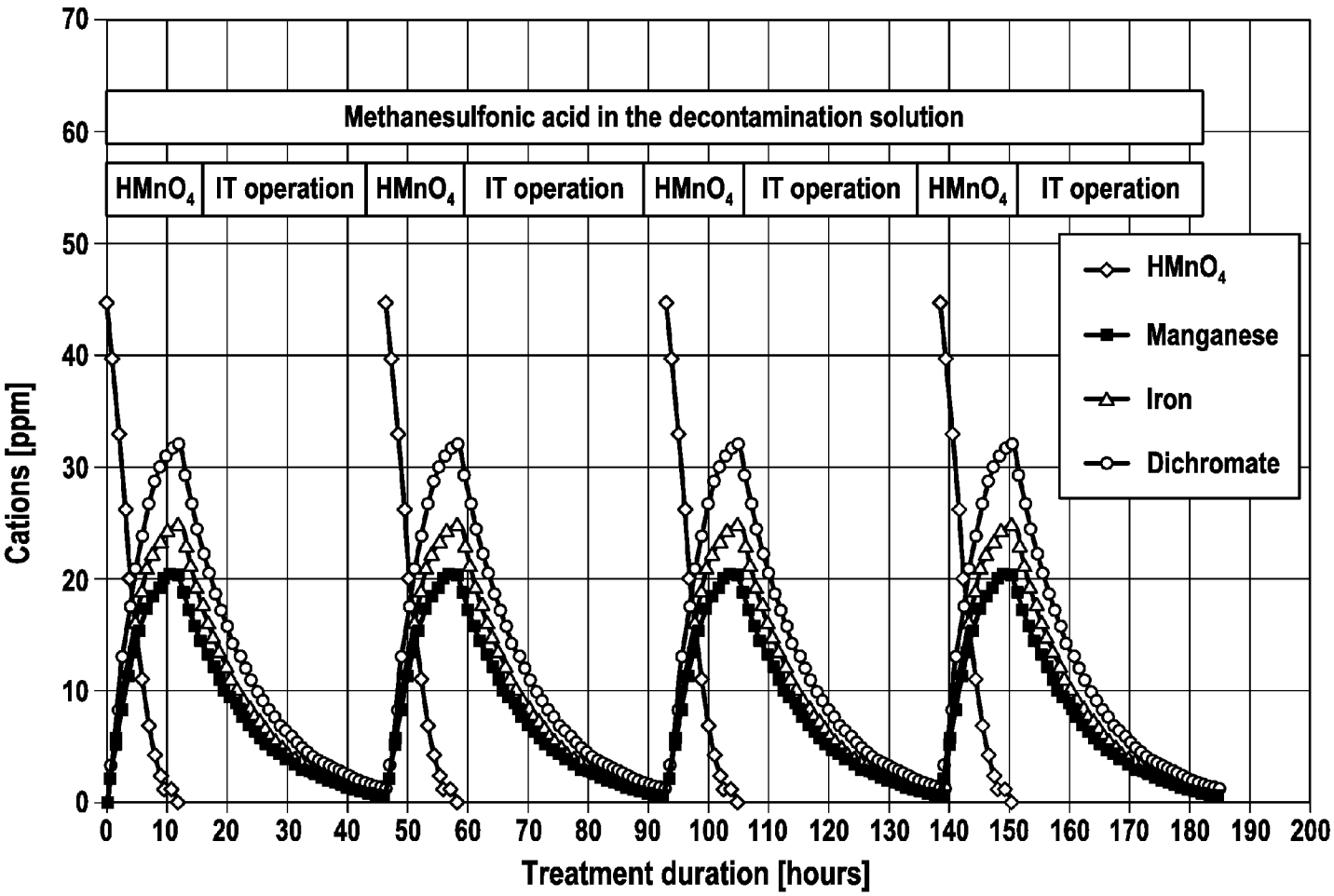

FIG. 2 shows the two stages of the decontamination process, in which the individual phases are defined as follows:

$HMnO_4$ stage=breaking up and dissolving the oxide matrix, loop operation K1 methanesulfonic+permanganic acid IT operation=fixing of dissolved cations and radionuclides on to ion-exchange resins
loop operation K1+parallel loop
operation K2
methanesulfonic acid/methane sulfonates FIG. 2 shows an example of the courses of the cation concentrations at a four-time $HMnO_4$ dosing as part of a PWR primary system decontamination.

According to the prior art, typically following pre-oxidation excess permanganate is reduced with oxalic acid (step II) and then the decontamination step (step III) is initiated by the addition of further decontamination chemicals.

In these conventional processes, at the time of reduction (step II) all components of the pre-oxidation step (residual permanganate, colloidal $MnO(OH)_2$, chromate and nickel permanganate) are still in the solution, and all converted metal oxides are on the system or component surface.

Since the metal ions are present in part in dissolved form ($MnO_4^-$, $CrO_4^{2-}$) as well as highly soluble metal oxides (NiO, FeO, $MnO_2$/$MnO(OH)_2$), already high cation solution concentrations occur in the course of the second process step of reduction (step II).

At the same time, large amounts of $CO_2$ form by the reduction of permanganate, chromate and manganese dioxide with oxalic acid (see equations (12-14)). This $CO_2$ formation that takes place on the surface, leads to a mobilization of oxide particles, which then settle in zones of low flow of the system increasing the dose rate in those locations.

$$2HMnO_4+7H_2C_2O_4 \rightarrow 2MnC_2O_4+10CO_2+8H_2O \quad \text{Equation (12)}$$

$$MnO_2+2H_2C_2O_4 \rightarrow MnC_2O_4+2CO_2+2H_2O \quad \text{Equation (13)}$$

$$Cr_2O_7^{2-}+3H_2C_2O_4+8(H_3O)^+ \rightarrow 2Cr^{3+}+6CO_2+15H_2O \quad \text{Equation (14)}$$

With the present invention, the $CO_2$ formation described above and release of oxide particles do not occur. The oxalate compounds, which are formed from divalent cations and the reducing agent "oxalic acid" have only limited solubility in water. Depending on the process temperature, the solubility of the divalent cations is at:

| | 50° C. | 80° C. | Unit |
|---|---|---|---|
| $NiC_2O_4$ | about 3 | about 6 | mg Ni-II/liter |
| $FeC_2O_4$ | about 15 | about 45 | mg Fe-II/liter |
| $MnC_2O_4$ | about 120 | about 170 | mg Mn-II/liter |

When using previous decontamination processes, in primary system decontamination, mathematically, large cation quantities are released per decontamination cycle. Already in the reduction step, this leads to oxalate precipitations on the inner surfaces of the systems.

The protective oxide layers of a primary system of a pressurized-water nuclear power plant usually result in total in an oxide inventory of 1,900 kg to 2400 kg [Fe, Cr, Ni oxide].

In the decontamination of a primary system of a pressurized water reactor therefore the following maximum cation release can be expected:

Chrome→70 to 80 kg of Cr

Nickel→100 to 120 kg of Ni

Iron→190 to 210 kg of Fe

In the primary system decontamination typically 3 decontamination cycles are carried out. At a total volume of about 600 $m^3$ and a uniform distribution of the cations over 3 cycles, the following concentrations of divalent cations can be expected per cycle:

Nickel→67 ppm of Ni

Iron→117 ppm of Fe

This rough estimate indicates that in all previous decontamination processes that use oxalic acid for reduction and/or decontamination, $Fe^{2+}$ and $Ni^{2+}$ oxalate formation cannot be avoided.

If, as described above, after completion of a decontamination cycle residual oxalate still remains in the system, more permanganate has to be used in the subsequent cycle, as equations (15), (16) show:

$$3NiC_2O_4+2HMnO_4+H_2O \rightarrow 3NiO+2MnO(OH)_2+6CO_2 \quad \text{Equation (15)}$$

$$3FeC_2O_4+2HMnO_4+H_2O \rightarrow 3FeO+2MnO(OH)_2+6CO_2 \quad \text{Equation (16)}$$

Without improving the decontamination result, this leads to a higher permanganate requirement, and as a result, to an increased $MnO(OH)_2$ deposition on the surfaces and ultimately, to a higher accumulation of the radioactive waste. Additionally, more cations enter the subsequent cycle, the risk of another oxalate formation increases, and the accumulation of ion exchange resins is further increased.

Already dissolved radionuclides (Co-58, Co-60, Mn-54) are incorporated in the oxalate layer. This leads to a recontamination in the systems.

As already described above, according to the present invention, in the oxidative "$HMnO_4$ stage" of the decontamination all released cations (Ni-II, Mn-II, Fe-II, Fe-III, Zn-II), and the dichromate are dissolved and the fixation of cations and anions is done by switching the bypass (loop K2) promptly to ion exchange resins.

Each nuclear power plant [PWR, BWR, etc.] has its own specific oxide structure, oxide composition, dissolution characteristics of the oxides, and oxide/activity inventory. In pre-planning of a decontamination only assumptions can be made. Only in the course of the decontamination it will be found out, whether the assumptions made previously were correct.

A decontamination concept must therefore be able to adapt to the respective changes when executed.

With the present invention, any conceivable new requirement can be addressed specifically. The detailed steps delineated above can be repeated any number of times depending on the type and quantity of the oxide/activity inventory present in the system.

Compared with previous processes techniques, a decontamination according to the present invention requires a very low concentration of chemicals. The required quantities of chemicals can therefore be metered with metering systems existing in nuclear power plants (NPPs) and the resulting cations can be removed by means of an NPP's own cleaning systems (ion exchanger). There is no need to install large external decontamination facilities.

By controlling the entire process by the power plant's control room, the process parameters can quickly be adjusted to any new requirements (metering of chemicals, chemical concentrations, process temperature, timing of IT exchanger integration, step sequences, etc.).

The process variations can be carried out, if necessary, until the desired discharge of activity or the desired dose rate reduction is achieved.

Methanesulfonic acid present in the solution remains in solution during execution of all process steps. Its concentration will not be changed. Only at the end of the entire decontamination process, methanesulfonic acid will be bound to ion exchange resins in the course of final cleaning.

Further details, advantages and features of the invention will be apparent not only from the claims—per se and/or in combination—but also from FIGS. 1 to 3 both already described above and described additionally below, which are self-explanatory.

In the figures:

FIG. 1 shows the working pH range of the present invention compared to the prior art, FIG. 2 shows the change in permanganic acid concentration and cation and dichromic acid concentration as a function of the duration of the process, FIG. 3 shows the schematic diagram of the decontamination loop (K1) and the IT cleaning loop (K2)

The diagram in FIG. 1 illustrates that a pH, as a function of permanganic acid concentration, falling below the oblique straight line shown in FIG. 1, ensures that manganese dioxide cannot form. According to the prior art, the process is carried out at a pH and a permanganic acid concentration which is above the straight line. Due to this, manganese dioxide forms. Here, the straight line is determined by equations (2) and (3).

FIG. 2 shows, in principle, the decontamination according to the invention. During all stages of decontamination the decontamination solution contains methanesulfonic acid to ensure a pH of ≤2.5. In the process step "$HMnO_4$ stage", permanganic acid is added to the solution to convert the insoluble Fe, CrNi oxide composite in highly soluble metal oxides, to dissolve the metal oxides at the same time and to form highly soluble methane sulfonates. Cr-III oxide is oxidized to Cr-VI and exists in the solution as dichromic acid. After permanganate has reacted completely or substantially completely with formation of $Mn^{2+}$, and the solution is substantially free of $MnO_4^-$ ions, in process step "IT operation" the solution flows via a bypass through ion exchanger IT (loop K2), where the dissolved cations and radionuclides are fixed. During IT operation methanesulfonic acid is released and is again available for the process.

Then, again, permanganic acid is added to the solution that no longer flows through the cation exchanger, according to the $Cr^{-3}$ to be oxidized in the Fe,CrNi oxide composite.

In the process step "$HMnO_4$ stage" a chemical conversion of the sparingly soluble Fe, Cr, Ni structure to more soluble oxides by means of permanganic acid takes place. Converted oxide formations are dissolved with methanesulfonic acid. Technically, this process is carried out in a methanesulfonic acid/permanganic acid solution in loop operation (loop K1) (FIG. 3). Loop operation K1 is maintained until permanganic acid is consumed completely and has been converted to $Mn^{2+}$. Usually the conversion of permanganic acid to $Mn^{2+}$ takes 2 to 4 hours, when at the beginning of the process the permanganic acid concentration has been adjusted in the range between 30 and 50 ppm. The conversion of the oxide structure and dissolution of the converted oxides takes place simultaneously. The final products of the dissolution process are metal salts of methanesulfonic acid. Following completion of the "$HMnO_4$ stage", the "IT stage" begins. Hereby, the metal cations which are present methylsulfonates and nuclides are passed in bypass (loop K2) through ion exchange resins and fixed there. During the "IT stage" both loops K1 and K2 are in operation. In the exchanger process, methanesulfonic acid is released and is again available for the decontamination solution.

The invention claimed is:

1. A process for dissolving a chromium, iron, nickel, zinc, and radionuclides containing an oxide layer, in particular for breaking down an oxide layer deposited on an inner surface of systems and components of a nuclear power plant, by means of an aqueous decontamination solution containing an acid, the process comprising:

dissolving the oxide layer in a single treatment step with the aid of an aqueous decontamination solution flowing in a first loop with methanesulfonic acid as the acid, wherein, during an entire carrying out of a decontamination in the first loop, methanesulfonic acid remains in the decontamination solution both as a proton donor, to adjust the decontamination solution at a pH≤2.5, and as an oxide solvent, wherein a dissolution of a chrome-containing oxide layer in the first loop is carried out with permanganic acid, and wherein, following a break-down of the permanganic acid, the decontamination solution flows through an ion exchanger via a bypass line in a second loop, while maintaining an operation of the first loop, and wherein 2-valent and 3-valent cations and the dissolved radionuclides are fixed in the ion exchanger, with a simultaneous release of methanesulfonic acid.

2. The process according to claim 1, wherein, in the decontamination solution, a concentration of methanesulfonic acid ≤3,500 ppm is set.

3. The process according to claim 2, wherein the concentration of methanesulfonic acid is from 500 to 1000 ppm.

4. The process according to claim 1, wherein, in the oxidation stage of the decontamination process, during which the decontamination solution flows into the first loop, the permanganic acid is set to a maximum concentration of 200 ppm.

5. The process according to claim 4, wherein the permanganic acid is set to a maximum concentration of 50 ppm.

6. The process according to claim 1, wherein a thickness of the oxide layer to be broken down is controlled by an amount of permanganic acid used.

7. The process according to claim 1, wherein all stages of decontamination are carried out at a temperature between 60° C. and 120° C.

8. The process according to claim 7, wherein the temperature is between 85° C. and 105° C.

9. The process according to claim 1, wherein Mn-II/Fe-II/Fe-III/Ni-II ions are removed by the ion exchanger.

10. The process according to claim 1, wherein the oxide layer is oxidized and dissolved by the decontamination solution containing permanganic acid and methanesulfonic acid recirculating in a first loop, wherein, after complete consumption of said permanganic acid, in a further recirculating operation, the decontamination solution is recirculated in a second loop via a bypass through an ion exchanger to bind Fe, Ni, Zn, Mn cations and radionuclides present in the solution, wherein, afterwards, said methanesulfonic acid solution is again supplied with permanganic acid, so that prior process steps ($HMnO_4$ stage, IT stage) are repeated to an extent until no more discharge of activity from the system to be decontaminated is detectable.

11. The process according to claim 1, wherein, at the beginning of breaking down the oxide layer, the pH is set by means of methanesulfonic acid, and wherein, during breaking down of the oxide layer and carrying out further process steps, a further addition of methanesulfonic acid is stopped.

12. The process according to claim 1, wherein, the pH is set by means of methanesulfonic acid to a value <2.5.

13. The process according to claim 12, wherein the pH is set to <2.2.

14. The process according to claim 12, wherein the pH is set to ≤2.0.

15. The process according to claim 1, wherein, a loop, or a partial loop thereof, of a nuclear installation is used as the first loop.

16. The process according to claim 15, wherein, a coolant loop, or a partial loop of the coolant loop, is used as the first loop.

* * * * *